US009756923B2

(12) United States Patent
Hasegawa

(10) Patent No.: US 9,756,923 B2
(45) Date of Patent: Sep. 12, 2017

(54) CONTAINER FOR COSMETIC MATERIAL

(71) Applicant: AMG Co., Ltd., Tokyo (JP)

(72) Inventor: Hiroki Hasegawa, Tokyo (JP)

(73) Assignee: AMG CO., LTD., Tokyo (JP)

( * ) Notice: Subject to any disclaimer, the term of this patent is extended or adjusted under 35 U.S.C. 154(b) by 45 days.

(21) Appl. No.: 14/764,903

(22) PCT Filed: Jul. 25, 2013

(86) PCT No.: PCT/JP2013/070154

§ 371 (c)(1),
(2) Date: Jul. 30, 2015

(87) PCT Pub. No.: WO2015/011814

PCT Pub. Date: Jan. 29, 2015

(65) Prior Publication Data

US 2016/0249725 A1 Sep. 1, 2016

(51) Int. Cl.
*B65D 81/24* (2006.01)
*A45D 34/00* (2006.01)
(Continued)

(52) U.S. Cl.
CPC ..... *A45D 34/00* (2013.01); *B05B 11/0043* (2013.01); *B05B 11/0078* (2013.01);
(Continued)

(58) Field of Classification Search
CPC ..... C02F 1/50; A45D 34/00; B65D 77/04; B65D 81/24; A61K 9/08; A61K 9/10;
(Continued)

(56) References Cited

U.S. PATENT DOCUMENTS 4,514,510 A * 4/1985 Alexander ..... A61K 8/26 501/146
5,132,115 A * 7/1992 Wolter ..... A45D 34/00 424/448

(Continued)

FOREIGN PATENT DOCUMENTS

JP 2003175390 A 6/2003
JP 2003225117 A 8/2003

(Continued)

OTHER PUBLICATIONS

International Search Report, Application No. PCT/JP2013/070154; Oct. 21, 2013.

*Primary Examiner* — Paul R Durand
*Assistant Examiner* — Andrew P Bainbridge
(74) *Attorney, Agent, or Firm* — Fulwider Patton LLP

(57) ABSTRACT

When a cosmetic material is stored for several months, even in the case where hydrogen is contained in the cosmetic material at the beginning, hydrogen is gradually effervesced from the cosmetic material and after a certain time period has passed, the anti-oxidant effect cannot be maintained. Therefore, to solve this problem, a hydrogen-enriched cosmetic material container has hydrogen encapsulated in a bag formed of a hydrogen permeable sheet; then placing the hydrogen bag together with a liquid cosmetic material into a soft case formed of a flexible and hydrogen impermeable sheet, and then connecting a manually operable pump member for dispensing the liquid cosmetic material in the soft case through an opening of the soft case in an airtight manner.

14 Claims, 8 Drawing Sheets

(51) Int. Cl.
*B01F 3/04* (2006.01)
*B65D 77/04* (2006.01)
*B05B 11/00* (2006.01)

(52) U.S. Cl.
CPC ..... *B01F 3/04* (2013.01); *B01F 3/04099* (2013.01); *B01F 2003/04843* (2013.01); *B01F 2003/04943* (2013.01); *B05B 11/0037* (2013.01); *B05B 11/3023* (2013.01); *B05B 11/3047* (2013.01); *B05B 11/3053* (2013.01); *B05B 11/3074* (2013.01); *B65D 77/04* (2013.01); *B65D 81/24* (2013.01)

(58) Field of Classification Search
CPC ..... B05B 11/0037; B05B 11/3023; B05B 11/3047; B01F 3/04; B01F 3/04099; B01F 2003/04843; B01F 2003/04943
USPC ..... 210/749, 764; 222/382, 380, 383.1, 222/383.3, 320–321.9, 92–107
See application file for complete search history.

(56) References Cited

U.S. PATENT DOCUMENTS 5,454,488 A * 10/1995 Geier ..... B05B 11/007 222/214
5,961,843 A * 10/1999 Hayakawa ..... A01N 25/26 210/192
6,070,763 A * 6/2000 Gueret ..... B05B 11/0024 222/105
6,460,739 B1 * 10/2002 Norris ..... B05B 11/3015 222/380
7,481,336 B2 * 1/2009 Arghyris ..... B05B 11/0018 222/105
2002/0150606 A1 * 10/2002 Yamada ..... A61K 8/0208 424/433
2004/0154993 A1 * 8/2004 Yanagihara ..... C02F 1/68 205/742
2005/0115984 A1 * 6/2005 Pritchett ..... B05B 11/0043 222/95
2005/0121399 A1 * 6/2005 Hayashi ..... A61K 33/00 210/749
2007/0148256 A1 * 6/2007 Yanagihara ..... A23L 2/52 424/600
2011/0104088 A1 * 5/2011 Herzog ..... A61K 8/35 424/60
2012/0207688 A1 * 8/2012 Guthery ..... A61K 9/0014 424/59
2013/0053612 A1 * 2/2013 Al-Anzi ..... B09B 1/004 588/250
2014/0023724 A1 * 1/2014 Fujimura ..... C02F 1/4678 424/600
2014/0247689 A1 * 9/2014 Wang ..... A23L 2/54 366/348
2016/0249725 A1 * 9/2016 Hasegawa ..... A45D 34/00

FOREIGN PATENT DOCUMENTS

JP 2005161209 A1 6/2005
JP 20103159981 U 6/2010
JP 201188663 A 5/2011
WO 2015011814 A1 1/2015

* cited by examiner

CONTAINER FOR COSMETIC MATERIAL

FIELD OF THE INVENTION

The present invention relates to a container which can keep hydrogen dissolved in a liquid cosmetic material for a predetermined time period and a cosmetic material containing hydrogen accommodated in the container.

Drinks such as water, tea, juice or the like in which hydrogen is dissolved in high concentration are available in various forms (Patent Publications No. 1 and No. 2). It is said that drinks containing hydrogen in high concentration can help to reduce and eliminate active oxygen which is harmful to health. Further, a cosmetic material such as skin lotion using dissolved hydrogen has a similar effect and various liquid cosmetic preparations such as skin lotion, mouthwash, shampoo are being sold.

PRIOR PUBLICATIONS

Patent Publications

Patent Publication No. 1:

Japanese Patent Application Laid Open No. 2003-175390

Patent Publication No. 2:

Japanese Patent Application Laid Open No. 2005-161209

DISCLOSURE OF THE INVENTION

Problems to be Solved by the Invention

However, since, unlike drinking water, a cosmetic material in the form of a liquid is to be used over a long time period such as several months, hydrogen dissolved in the liquid cosmetic material gradually effervesces more or less similarly to the way that carbon dioxide dissolved in a carbonated drink effervesces. Therefore, hydrogen is dissolved in the liquid cosmetic material when the container containing the liquid cosmetic material is first opened, but the dissolved hydrogen escapes by effervesce over a certain time period so that the effect obtained just after opening the container can be no longer obtained. Thus, it is an object of the present invention to provide a container which can keep hydrogen dissolved in a liquid cosmetic material for a long time period and a cosmetic material containing hydrogen accommodated in said container.

Means for Solving Problems

The present invention solves the above mentioned problems by the following technical means.

Specifically, an invention defined in claim 1 is directed to a hydrogen-enriched cosmetic material container constituted by encapsulating hydrogen gas in a hydrogen bag 2 formed of a hydrogen gas permeable sheet, accommodating the hydrogen bag 2 together with a liquid cosmetic material into a soft case 3 formed of a flexible and hydrogen gas impermeable material, and connecting to an opening of the soft case 3 a manual pump member 4 for sucking the liquid cosmetic material in the soft case 3 and ejecting it to the outside in an airtight manner.

Further, an invention defined in claim 2 is directed to a hydrogen-enriched cosmetic material container in accordance with claim 1, which further comprises a shut-off valve 120 disposed at a discharge opening 12 of the pump member 4, wherein the shut-off valve 120 is constituted so as to open the discharge opening 12 in response to an operation of pushing the pump member 4 to discharge liquid cosmetic material contained in the soft case 3 and close the discharge opening 12 in response to stopping the pushing operation.

Moreover, an invention defined in Claim 3 is directed to a hydrogen-enriched cosmetic material in accordance with Claim 1 or 2, wherein the hydrogen bag 2 is provided with a check valve 5.

Furthermore, an invention defined in Claim 4 is directed to a hydrogen-enriched cosmetic material container, wherein the soft case 3 is accommodated in a hard case 6 formed of a hard material and the pump member 4 is provided at the opening of the hard case 6.

Further, an invention defined in Claim 5 is directed to a liquid cosmetic material encapsulated in the hydrogen-enriched cosmetic material container defined in any one of Claims 1 to 3.

Moreover, an invention defined in Claim 6 is directed to a liquid cosmetic material encapsulated in the soft case 3 accommodated in the hard cosmetic material case defined in Claim 4.

Technical Effects of the Invention

According to the invention defined in Claim 1, since hydrogen is encapsulated in the hydrogen bag 2 formed of the hydrogen gas permeable sheet and this bag is accommodated together with the liquid cosmetic material in the soft case 3 formed of the flexible and hydrogen gas impermeable material, hydrogen gradually penetrates through the hydrogen bag 2 to be dissolved in the liquid cosmetic material, whereby hydrogen can be retained in the liquid cosmetic material for a long time period.

In addition, since the hydrogen gas impermeable material is flexible, the hydrogen-enriched cosmetic material container can be made inexpensively. Furthermore, since the shape of the hydrogen-enriched cosmetic material container can be formed flat, it is possible to prevent the cost of transporting the hydrogen-enriched cosmetic material container from increasing.

Moreover, since the manual pump member 4 for sucking the liquid cosmetic material in the soft case 3 and ejecting it to the outside is connected to the opening of the soft case 3 in an airtight manner, it is possible to suppress the amount of discharge of hydrogen effervesced from the liquid cosmetic material to the outside. As a result, hydrogen can be retained in the liquid cosmetic material for a long time period.

According to the invention defined in Claim 2, in addition to the technical effects obtained by the invention defined in Claim 1, it is possible to suppress the amount of discharge of hydrogen contained in the cosmetic material remaining in the pump member 4 to the outside, since the shut-off valve 120 provided at the discharge opening 12 of the pump member 4 opens the discharge opening 12 in response to the operation of pushing the pump member 4 to discharge liquid cosmetic material in the soft case 3 and closes the discharge opening 12 in response to stopping the pushing operation of the pump member 4. As a result, therefore, even hydrogen contained in the cosmetic material remaining in the valve member 4 can be retained therein for a long time period.

According to the invention defined in Claim 3, in addition to the technical effects obtained by the invention defined in Claim 1 or 2, it becomes easy to encapsulate hydrogen in the hydrogen bag 2, because the hydrogen bag 2 is provided with the check valve 5.

According to the invention defined in Claim 4, since the soft case 3 is accommodated in the hard case 6 formed of the hard material, it is possible to replace only the hydrogen-enriched cosmetic material container. Therefore, disposal of the hard case 6 as waste can be avoided and it becomes possible not only to minimize the cost of manufacturing the cosmetic material but also to reduce material waste.

Since the pump member 4 is provided at the opening of the hard case 6, it is unnecessary to remove the hydrogen-enriched cosmetic material container from the hard case 6 each time the cosmetic material is discharged.

Claim 5 provides cosmetic material encapsulated in the hydrogen-enriched cosmetic material container defined in any one of claims 1 to 3. Therefore, it is possible to retain hydrogen in the cosmetic material for a long time period and a user of the cosmetic material can enjoy the effects produced by the hydrogen contained in the cosmetic material for a long time period.

According to the invention defined in Claim 6, the cosmetic material is encapsulated in the soft case 3 accommodated in the hard cosmetic material container as defined in Claim 4. Therefore, it is possible to retain hydrogen in the cosmetic material for a long time period and a user of the cosmetic material can enjoy the effects produced by the hydrogen contained in the cosmetic material for a long time period.

A preferred embodiment of the present invention will be described below with reference to the accompanying drawings. In this specification, the "top and bottom" of a hydrogen-enriched cosmetic material container means the "top and bottom" thereof in FIG. 1 and a side on which a discharge opening 12 is provided in the case where the hydrogen-enriched cosmetic material container is viewed along the vertical axis at the center of the container is referred to as "front" and the opposite side is referred to as "rear". A "liquid cosmetic material" means a cosmetic material in a liquid state, including a colloid solution, and concretely speaking, it means a cosmetic lotion, dentifrice, bath preparation or the like.

Figure 1:
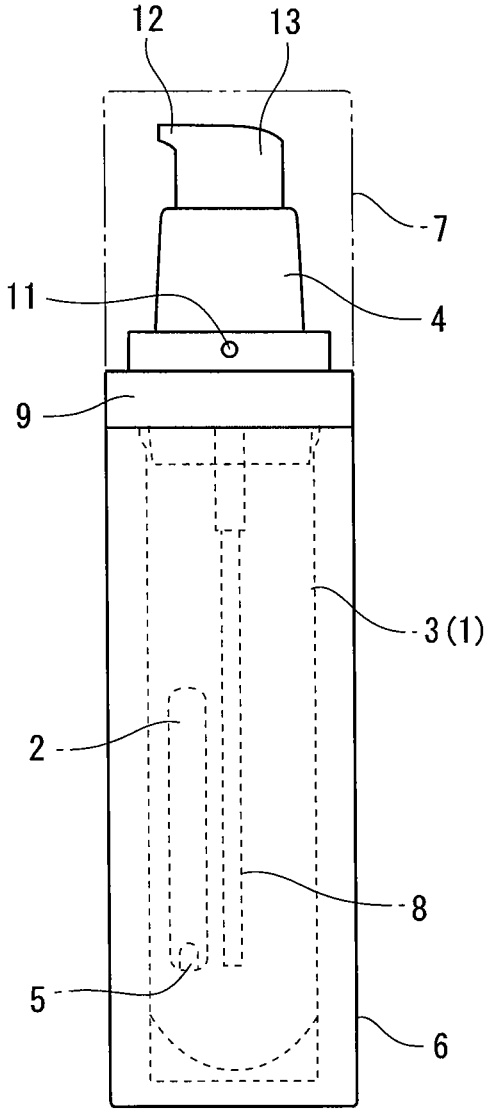
FIG. 1 is a side view of a hard cosmetic material container according to the present invention.
Figure 2:
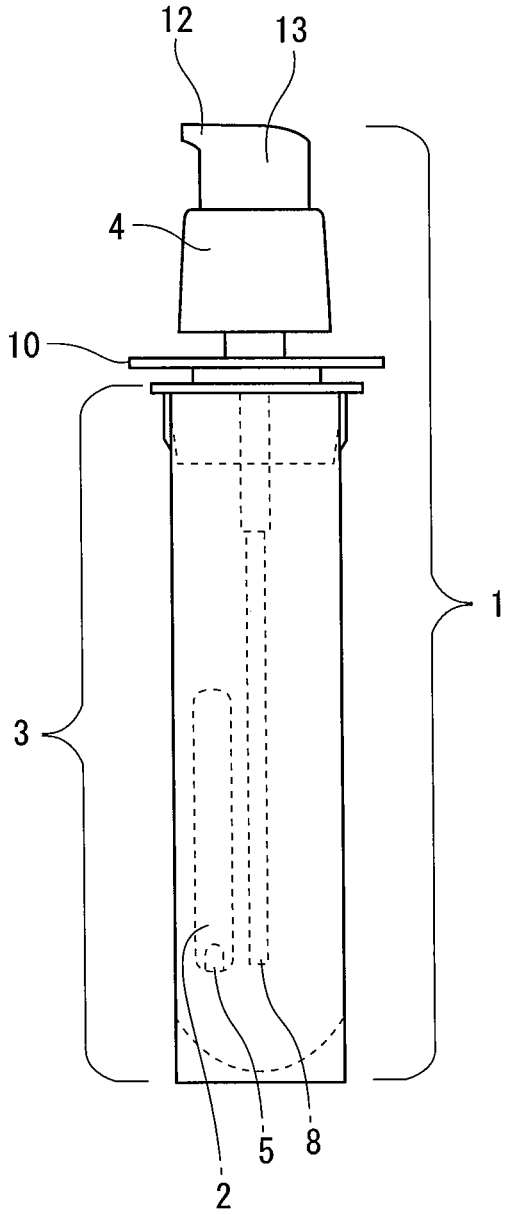
FIG. 2 is a side view of a hydrogen-enriched cosmetic material container in which a cosmetic material is to be encapsulated according to the present invention.
Figure 3:
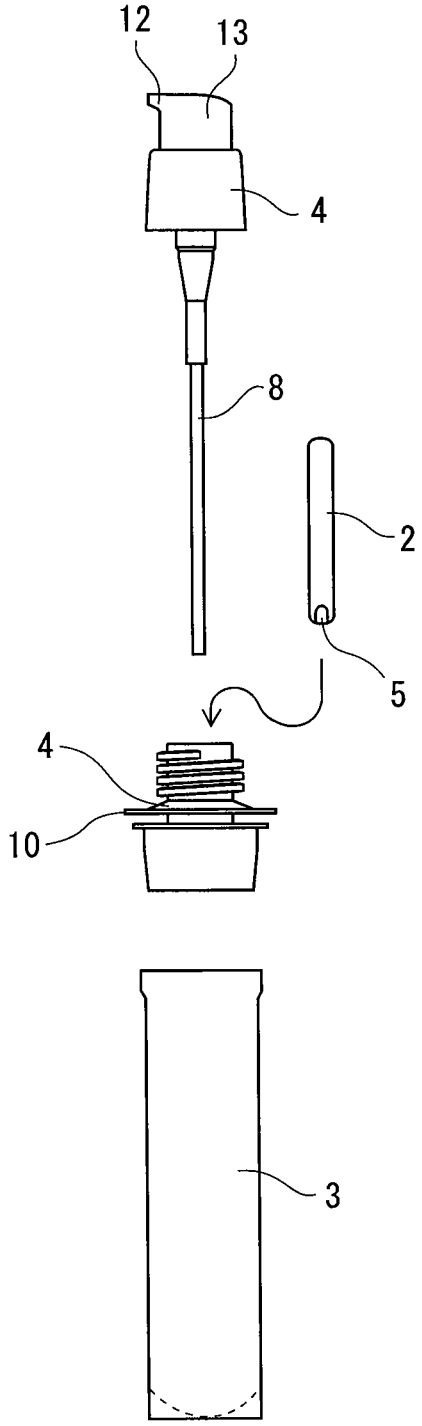
FIG. 3 is an assembly diagram of a hydrogen-enriched cosmetic material container shown in FIG. 2.

FIG. 1 shows a side view of a hard cosmetic material container according to a first preferred embodiment of the present invention, FIG. 2 shows a side view of the hydrogen-enriched cosmetic material container itself according to the preferred embodiment of the present invention and FIG. 3 is an assembly diagram of the hydrogen-enriched cosmetic material container shown in FIG. 2.

The hydrogen-enriched cosmetic material container is constituted by connecting a manual pump member 4 in an airtight manner to an opening of a bag-shaped soft case 3 formed of a hydrogen gas impermeable material. As the hydrogen gas impermeable material, a soft laminated sheet used for a retort pouch can be adopted, for example, and the soft laminated sheet is produced by laminating polyester (PET) as an outer layer, an aluminum foil as an intermediate layer and non-oriented polypropylene (CPP) as an inner layer. In this preferred embodiment of the present invention, the soft case 3 is constituted by thermally welding both right and left end portions of two laminated sheets which are long in the vertical direction and welding a bottom surface sheet to a bottom portion so as to form a godet, whereby the hydrogen-enriched cosmetic material container can stand by itself when a cosmetic material is encapsulated therein.

The pump member 4 includes a known manually operable pump mechanism and is constituted of polypropylene (PP) or the like. The known manually operable pump mechanism is constituted by arranging two check valves or mechanisms like a check valve in the vertical direction so that liquid present between the two valves is discharged by pushing a head portion of the pump and liquid present therein is sucked by returning the head portion of the pump to its original position into a portion between the two valves. In this preferred embodiment, when a user pushes a press portion 13 from above, a cosmetic material is discharged by increments to the outside through the discharge opening 12 and when the press portion 13 is returned to its original position by a biasing member provided in the press portion 13, a liquid cosmetic material in a soft case 3 is sucked by increments through a suction tube 8. The operation of the pump member 4 will be explained below in detail.

The pump member 4 includes a base portion to be adhered to an opening of the soft case 3. The bag-shaped soft case 3 is thermally welded to this base portion, whereby they are connected in an airtight manner. On the other hand, the base portion is formed with a flange 10 for fixing the hydrogen-enriched cosmetic material container to a hard case 6 described later.

A hydrogen bag 2 formed of a hydrogen gas permeable sheet is accommodated together with a liquid cosmetic material in the hydrogen-enriched cosmetic material container according to the preferred embodiment of the present invention. Here, the hydrogen gas permeable sheet for forming the hydrogen bag 2 is defined as a sheet through which hydrogen passes at a given rate and a conventional vinyl sheet falls under the category of the hydrogen gas permeable sheet. The rate of hydrogen passage through the hydrogen gas permeable sheet can be adjusted by selecting the material used for forming the hydrogen gas permeable sheet. For example, in the case where silica is incorporated, the rate of hydrogen passage through the hydrogen gas permeable sheet becomes small. It is possible to form only a part of the hydrogen bag 2 of a hydrogen gas permeable sheet.

The hydrogen bag 2 is formed with a check valve 5. The check valve 5 is a known one generally used for an air cushion or a quilt compression bag. If a pipe for injecting hydrogen is inserted into the check valve 5, hydrogen can be easily injected into the hydrogen bag 2 and on the other hand, the hydrogen bag 2 can be easily sealed by pulling out the pipe from the hydrogen bag 2. As a hydrogen gas to be encapsulated into the hydrogen bag 2, it is possible to use hydrogen generated by a hydrogen generator.

Referring to FIG. 3, a method for assembling the hydrogen-enriched cosmetic material container will be explained below. At first, a base portion for constituting the pump member 4 and bag-shaped soft case 3 are thermally welded in an airtight manner. Next, the hydrogen bag 2 containing hydrogen and a predetermined amount of the liquid cosmetic material are put in the soft case 3. Then, a portion of the pump member 4 which has the built-in pump mechanism is fixed using the thread formed at the base portion of the pump member 4. In this state, the hydrogen-enriched cosmetic material container can be commercially distributed as a hydrogen containing cosmetic material.

By putting the hydrogen bag 2 which encapsulates hydrogen in the soft case 3 formed of the hydrogen gas impermeable material together with the liquid cosmetic material, it becomes possible for hydrogen gradually to penetrate through the hydrogen bag 2 into the liquid cosmetic material, whereby the cosmetic material can retain hydrogen for a long time period.

Further, since the manually operable pump member 4 for sucking the liquid cosmetic material contained in the soft case 3 and ejecting to the outside is connected to an opening of the soft case 3 in an airtight manner, according to this hydrogen-enriched cosmetic material container, it is possible to suppress the amount of discharge of hydrogen effervesced from the liquid cosmetic material to the outside, whereby the cosmetic material can retain hydrogen for a long time period.

Furthermore, since the hydrogen bag 2 is provided with the check valve 5, it is possible to easily encapsulate hydrogen in the hydrogen bag 2.

Since the hydrogen gas impermeable material is a soft sheet through which hydrogen cannot pass, it is possible to produce the hydrogen-enriched cosmetic material container at a low cost. Further, since the hydrogen-enriched cosmetic material container can be shaped flat, the cost of transporting it can be held down.

Figure 4:
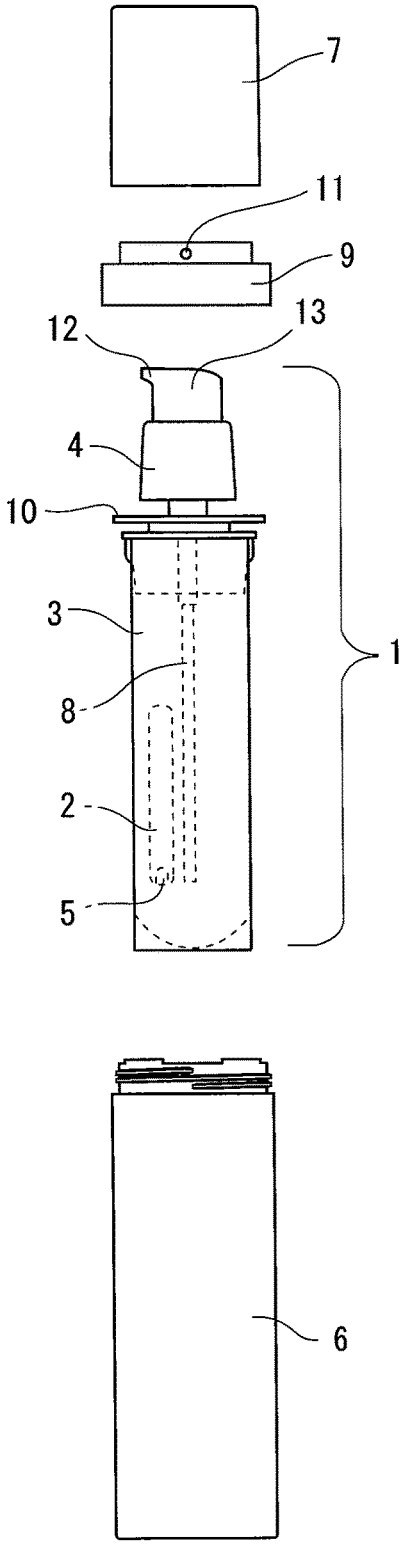
FIG. 4 is an assembly diagram of a hydrogen-enriched cosmetic material container shown in FIG. 2 when it is to be accommodated in a hard case.
Figure 5:
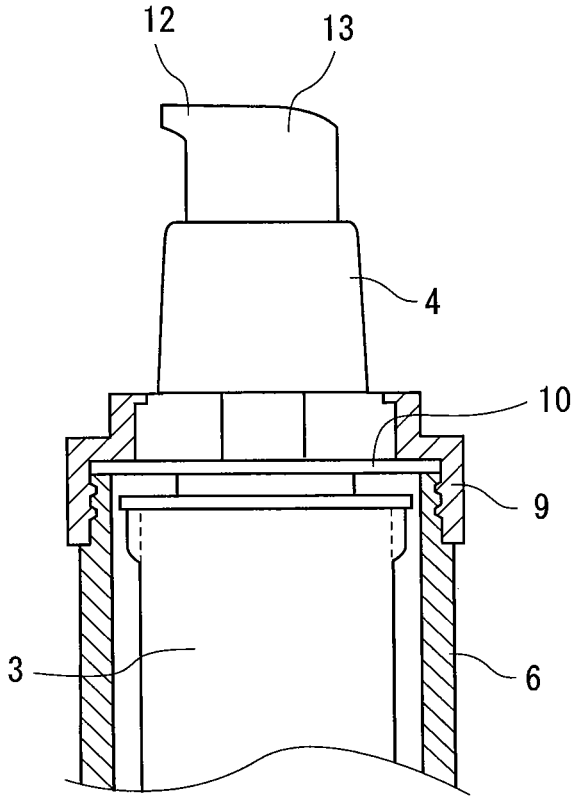
FIG. 5 is a front partial cross-sectional view of a hydrogen-enriched cosmetic material container shown in FIG. 2 after being accommodated in a hard case.

FIG. 4 is an assembly diagram of the hydrogen-enriched cosmetic material container when it is accommodated in the hard case 6 and FIG. 5 is a front partial cross-sectional view of the hydrogen-enriched cosmetic material container which is accommodated in the hard case 6. It is necessary for a case of a cosmetic material to have an imposing and elegant appearance matching the fine quality of the cosmetic material contained therein. It is common for a first-rate cosmetic material to be packaged in a hard case. However, after the cosmetic material has been used up, the hard case is disposed of, so that resources are wasted and cost of a case comes to account for a large proportion of the sales price of the cosmetic material product.

In this preferred embodiment of the present invention, after the cosmetic material has been encapsulated in the hydrogen-enriched cosmetic material container, a hard case 6 for accommodating the hydrogen-enriched cosmetic material container is provided. The hydrogen-enriched cosmetic material container for commercial distribution is inserted in the hard case 6 and the flange 10 of the hydrogen-enriched cosmetic material container is fitted into a cut portion provided at the rim of the hard case 6. Further, a securing ring 9 is threadably mounted on the hard case 6, thereby fixing the hydrogen-enriched cosmetic material container to the hard case 6. The inner diameter of the securing ring 9 is determined so that the press portion 13 of the pump member 4 of the hydrogen-enriched cosmetic material container can pass through the securing ring 9. Thus, even in the case where the hydrogen-enriched cosmetic material container is fixed to the hard case 6 by the securing ring 9, the press portion 13 of the pump member 4 can be disposed so as to project outwardly from the hard case 6.

In this embodiment, since the hard case 6 for accommodating the hydrogen-enriched cosmetic material container is provided, only the hydrogen-enriched cosmetic material container needs to be replaced. Therefore, since the hard case 6 is not wastefully disposed of, the cost of manufacturing the cosmetic material can be held down and the amount of wasted material can be reduced.

By disposing the press portion 13 of the pump member 4 so as to project outwardly from the hard case 6, it becomes unnecessary to remove the hydrogen-enriched cosmetic material container from the hard case 6 each time the cosmetic material is discharged therefrom.

Figure 6:
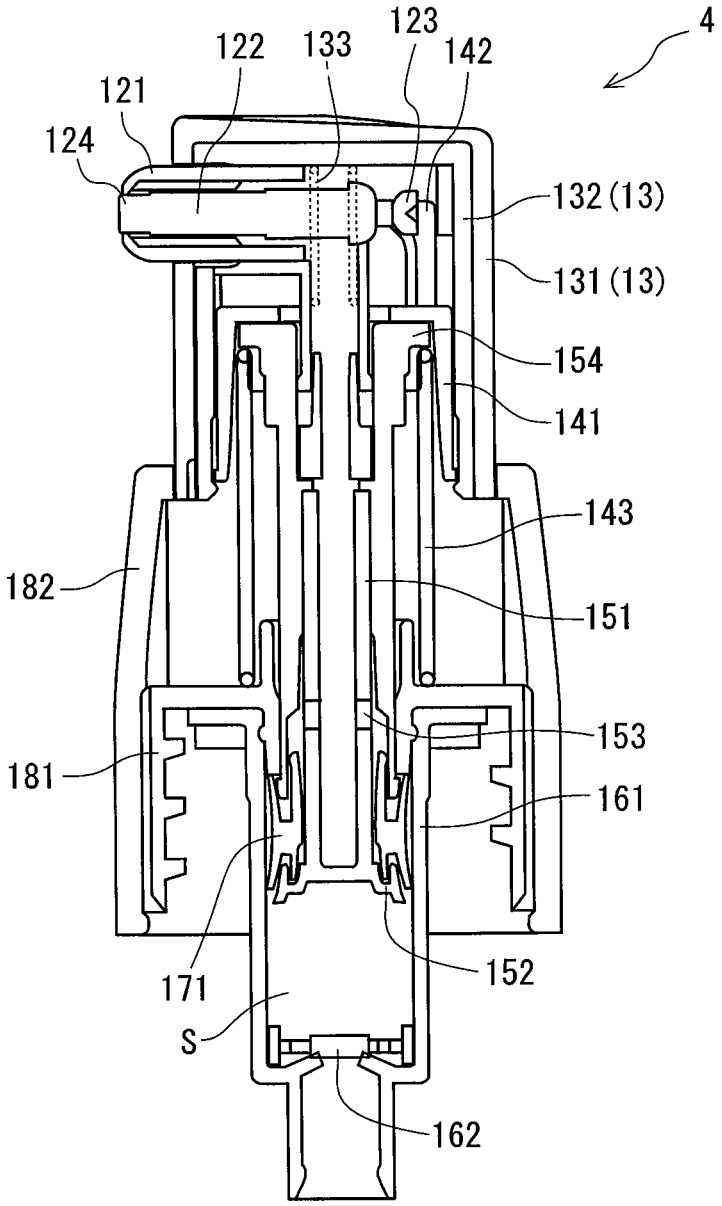
FIG. 6 is a diagram showing the operation of a pump member of a hydrogen-enriched cosmetic material container.
Figure 7:
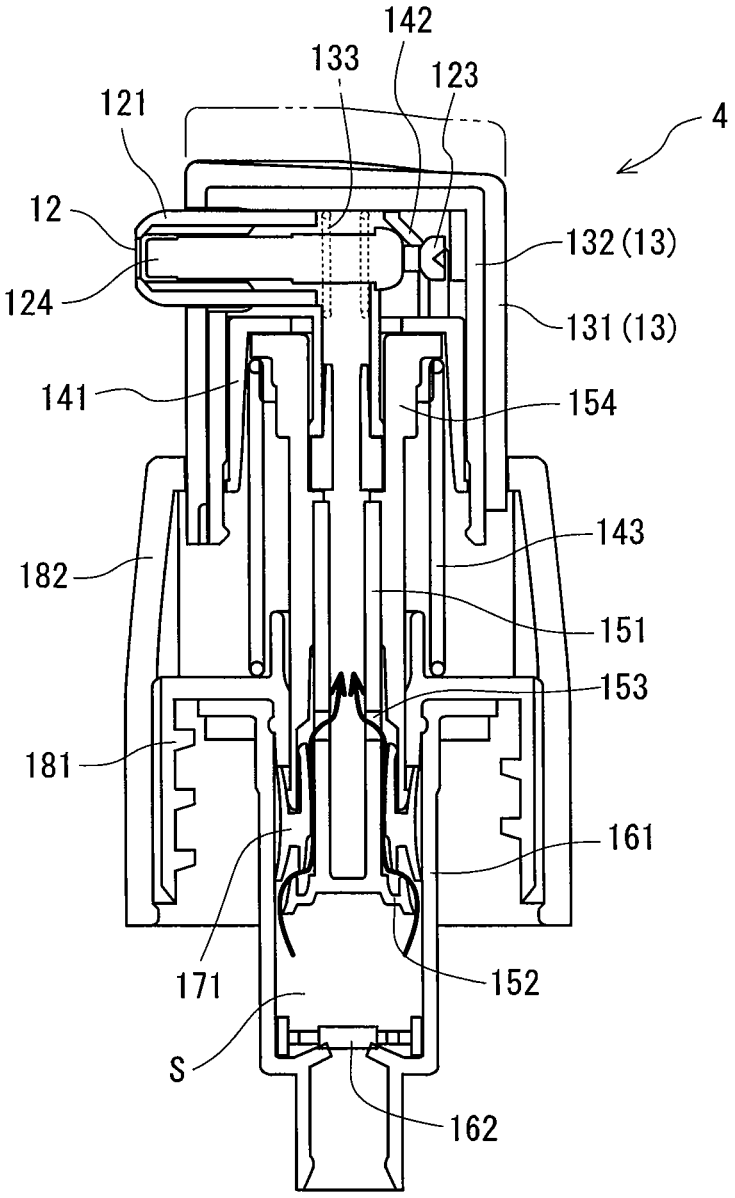
FIG. 7 is a diagram showing the operation of a pump member of a hydrogen-enriched cosmetic material container.
Figure 8:
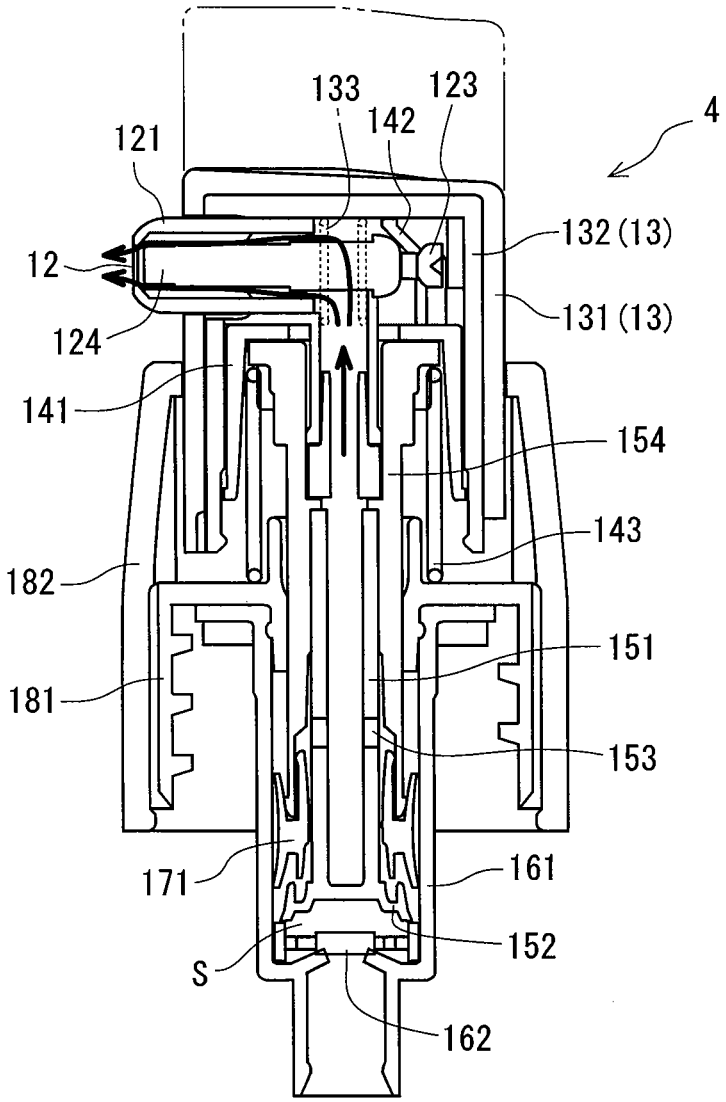
FIG. 8 is a diagram showing the operation of a pump member of a hydrogen-enriched cosmetic material container.

The operation and function of the pump member 4 will be explained below referring to FIGS. 6 to 8. Each of FIGS. 6 to 8 is a diagram showing the operation of the pump member 4 of the hydrogen-enriched cosmetic material container and is a side cross-sectional view of the pump member 4. FIG. 6 shows a pause mode where the pressure of the finger of the user of the cosmetic material is not applied to the pump member 4, FIG. 7 shows a first pressurizing mode where an initial pressure is applied by the finger of the user to the pump member 4 and FIG. 8 shows a second pressurizing mode where the press portion 13 has been lowered to a maximum extent by the user, respectively.

At first, the pump mechanism of the pump member 4 will be explained below. A decoration cap 182 is provided outside of a cap 181 which is to be threadably mounted on the base portion of the soft case 3 and a cylindrical housing 161 which communicates with a suction tube 8 is fixed to the cap 181. The central portion of the lower portion of the housing 161 is formed with a bore and a diaphragm valve 162 is provided so as to stop up the bore. The diaphragm valve 162 is a check valve and includes a circular disc for stopping up the bore located at the central portion of the lower surface of the housing and passing bores through which the cosmetic material passes provided at an outer circumference of the circular disc. When pressure within inner space S becomes lower than that of the outside, the circular disc of the diaphragm valve 162 is lifted from the bore located at the central portion of the lower surface of the housing and the cosmetic material flows into the inner space S through the suction tube 8.

A stem supporter 154 is provided so as to be movable relative to the housing 161 in the vertical direction. The stem supporter 154 is guided by the inner bore of the cap 181 and movable relative to the housing and the like in the vertical direction. A first compression spring 143 is provided between the stem supporter 154 and the cap 181 so as to always bias the stem supporter 154 upwardly. A central stem 151 is fixed to the inside of the stem supporter 154 so as not to be movable in the vertical direction. The central stem 151 is formed with lateral bores 153. A ring piston 171 which is movable in the vertical direction is provided between the central stem 151 and the stem supporter 154. The upper portion of the ring piston 171 is formed with a groove engageable with the lower portion of the stem supporter 154 and the lower portion of the ring piston 171 is formed with a lower concave portion 152 engageable with an upward projection of the lower portion of the central stem 151. The outer circumference of the central stem 151 is comparatively loosely fitted into the inner circumference of the ring piston 171, while the outer circumference of the ring piston 171 is comparatively tightly fitted into the inner circumference of the housing 161. Further, the ring piston 171 is formed with grooves extending in the vertical direction.

In the pause mode shown in FIG. 6, the lower portion of the ring piston 171 comes into the lower concave portion 152 of the central stem 151. When the user pushes the press portion 13, since the central stem 151 moves downwardly and the ring piston 171 is held at its original position due to the friction between itself and the housing 161, a gap is formed between the lower portion of the ring piston 171 and the lower portion of the central stem 151. This gap serves as a check valve and the gap is maintained in the case of transferring from the first pressurizing mode to the second pressurizing mode so that the liquid cosmetic material held in the inner space S passes through the groove communicating with the upper and lower portions of the ring piston 171 and the lateral bores 153 of the central stem 151 and flows into a cylinder inner chamber of the central stem 151.

In this manner, two elements each serving as a check valve are disposed vertically, thereby constituting the pump mechanism.

In the pump member 4 according to the first embodiment of the present invention, a shut-off valve 120 is provided, in addition to the pump mechanism, at the discharge opening 12. The shut-off valve 120 serves to prevent the cosmetic material in a liquid form from dripping off from the discharge opening 12 and prevent the liquid cosmetic material remaining in a portion from a valve disposed on the side of the discharge opening 12 constituting the pump mechanism 4 to the discharge opening 12 from oxidizing.

The press portion 13 on which the user of the cosmetic material pushes is provided at an upper portion of the pump member 4 and when the press portion 13 is pushed downwardly, the liquid cosmetic material is ejected to the outside. The press portion 13 is constituted by a press portion outer shell 131 and a press portion inner shell 132 and a discharge opening external cylinder 121 constituting the discharge opening 12 is fixed to the press portion outer shell 131 and the like. The discharge opening 12 is constituted by the discharge opening external cylinder 121 and a discharge opening inner shaft 122 movable relative to the discharge opening external cylinder 121 in the front-back direction. An upper supporting portion 141 which is bottomed cylindrical is provided in the stem supporter 154 constituting the pump mechanism and the upper supporting portion 141 is movable vertically with respect to the press portion outer shell 131. Between the upper supporting portion 141 and the press portion inner shell 132, second compression springs 133, 133 are provided. The second compression springs 133, 133 are disposed on both sides of the discharge opening external cylinder 121 as a pair of the second compression springs 133, 133 and a spring constant of the second compression springs 133, 133 arranged in parallel with each other is lower than that of the first compression spring 143. A slanted engageable portion 142 is erected at the upper supporting portion 141 for engaging with a rear engageable portion 123 of the discharge opening inner shaft 122. The portion where the upper supporting portion 141 engages with the rear engageable portion 123 declines backward.

In the pause mode shown in FIG. 6, when the user presses the press portion 13, the first compression spring 143 is compressed and the second compression springs 133, 133 are simultaneously compressed in response to the pushing operation of the user, whereby the mode is transferred to the first pressurizing mode shown in FIG. 7. As described above, in the first pressurizing mode, since the first compression spring 143 is compressed, a gap is generated between the lower portion of the central stem 151 and the lower portion of the piston 171. In synchronism with the compression of the first compression spring 143, since the second compression springs 133, 133 are also compressed, the vertical distance between the upper supporting portion 141 and the press portion inner shell 132 becomes shorter. As a result, the discharge opening inner shaft 122 is moved rearward by the slanted engageable portion 142 of the upper supporting portion 141 and a depressed portion 124 of the discharge opening inner shaft 122 also is moved rearward, whereby the discharge opening 12 is opened. When the mode is transferred from the first pressurizing mode shown in FIG. 7 to the second pressurizing mode shown in FIG. 8, the volume in the inner space S becomes small, whereby the liquid cosmetic material remaining in the inner space S is discharged from the inner cylinder of the central stem 151 through the discharge opening 12 to the outside as indicated by an arrow shown in FIG. 8.

In a relax mode where the user of the cosmetic material stops the operation of pressing the press portion 13, the vertical distance between the upper supporting portion 141 and the press portion inner shell 132 becomes longer owing to the biasing force of the second compression springs 133, 133, whereby the discharge opening inner shaft 122 moves forward in accordance with the slope of the slanted engageable portion 142 so that the discharge opening 12 is closed. In addition, when the operation of pressing the press portion 13 is stopped, the stem supporter 154 and the central stem 151 are moved upwardly by the biasing force of the first compression spring 143, whereby the lower portion of the ring piston 171 gets fitted in the lower concave portion 152 located at the lower portion of the central stem 151 and the gap vanishes. As a result, the inner pressure in the inner space S decreases and the liquid cosmetic material contained in the soft case 3 flows into the inner space S through the diaphragm valve 162.

In response to the press operation onto the pump member 4, the shut-off valve 120 provided at the discharge opening 12 of the pump member 4 opens the discharge opening 12 to discharge the liquid cosmetic material contained in the soft case 3. In addition, when the press operation onto the pump member 4 is stopped, since the discharge opening 12 is closed, it is possible to suppress the amount of discharge of hydrogen contained in the liquid cosmetic material remaining in the pump member 4 to the outside. As a result, the liquid cosmetic material remaining in the pump member 4 can retain hydrogen for a long time period.

A method for using the liquid cosmetic material containing hydrogen according the present invention will be explained below. At first, when the user purchases cosmetic material, the hydrogen-enriched cosmetic material container is fixed to the hard case 6 and a cap 7 is mounted on the hard case 6 as shown FIG. 1. At this point, the hydrogen bag 2 containing hydrogen is accommodated in the hydrogen-enriched cosmetic material container together with the cosmetic material and hydrogen escapes little by little from the pump member 4. Correspondingly to the escape of the hydrogen from the pump member 4, hydrogen penetrates the hydrogen bag 2, thereby keeping the amount of hydrogen dissolved in the liquid cosmetic material contained in the hydrogen dissolved cosmetic material container to be constant. Since the pump member 4 is provided with the shut-off valve 120 in addition to the pump mechanism, it is possible to minimize the amount of escaping hydrogen and hydrogen penetrates through the hydrogen bag 2 little by little, whereby hydrogen can be kept dissolved in the liquid cosmetic material for two or three months during which the user uses up the cosmetic material. Here, since the soft case 3 is formed of a soft sheet, the thickness of the flattened soft case 3 becomes thinner every time the cosmetic material is consumed and the amount of the cosmetic material contained in the soft case 3 is reduced.

When the user runs out of the cosmetic material containing hydrogen in the hard case 6 which the user purchases as a unit, it suffices for the user to purchase only the hydrogen-enriched cosmetic material container encapsulating the cosmetic material containing hydrogen. Thus, since the user need not purchase the hard case 6 accommodating the hydrogen-enriched cosmetic material container, the user can purchase a cosmetic material containing hydrogen less expensively. After purchasing the hydrogen-enriched cosmetic material container, the user removes the securing ring 9 from the hard case 6 and takes out the old hydrogen-enriched cosmetic material container no longer containing liquid cosmetic material. Then, the user inserts the newly purchased hydrogen-enriched cosmetic material container into the hard case 6 and fixes the hydrogen-enriched cosmetic material container using the securing ring 9. In this manner, it is possible to reuse the costly hard case 6 and the amount of disposed waste can be reduced.

Although the hydrogen bag 2 is accommodated in the soft case 3 in the above described preferred embodiment of the present invention, it is possible to divide the inside of the soft case 3 formed of a hydrogen gas impermeable material into two rooms by a hydrogen gas permeable sheet and encapsulate hydrogen into one of the rooms.

Further, although the check valve 5 is provided in the hydrogen bag 2 in the above described preferred embodiment of the present invention, in order to further reduce the cost of the liquid cosmetic material in which hydrogen is dissolved, it is possible to seal the hydrogen bag 2 using a thermal welding technique or the like without providing the check valve 5.

Furthermore, although a soft sheet is used as the hydrogen gas impermeable sheet in the above described preferred embodiment of the present invention, instead of using the soft sheet, it is possible to use a hard material through which hydrogen cannot penetrate.

EXPLANATION OF REFERENCE NUMERALS

1 a hydrogen-enriched cosmetic material container
2 a hydrogen bag
3 a soft case
4 a pump member
5 a check valve
6 a hard case
12 a discharging opening
13 a press portion
120 a shut-off valve

The invention claimed is:

1. A hydrogen-enriched cosmetic material container constituted by encapsulating hydrogen gas into a hydrogen-encapsulating bag formed of a hydrogen gas permeable sheet, accommodating the hydrogen-encapsulating bag together with a liquid cosmetic material into a soft case formed of a flexible and hydrogen gas impermeable material; and connecting to an opening of the soft case a manual pump member for sucking the liquid cosmetic material in the soft case and ejecting it to the outside in an airtight manner.

2. A hydrogen-enriched cosmetic material container in accordance with claim 1, which further comprises a shut-off valve disposed at a discharge opening of the pump member; and wherein the shut-off valve is constituted so as to open the discharge opening in response to an operation of pushing the pump member to discharge liquid cosmetic material contained in the soft case and close the discharge opening in response to stopping the pushing operation.

3. A hydrogen-enriched cosmetic material container in accordance with claim 1, wherein the hydrogen-encapsulating bag is provided with a check valve.

4. A hydrogen-enriched cosmetic material container in accordance with claim 1, wherein the soft case is accommodated in a hard case formed of a hard material and the pump member is disposed at an opening of the hard case.

5. A liquid cosmetic material encapsulated in the hydrogen-enriched cosmetic material container defined in claim 1.

6. A liquid cosmetic material encapsulated in the soft case accommodated in the hard case defined in claim 4.

7. A hydrogen-enriched cosmetic material container in accordance with claim 3, wherein the soft case is accommodated in a hard case formed of a hard material and the pump member is disposed at an opening of the hard case.

8. A liquid cosmetic material encapsulated in the hydrogen-enriched cosmetic material container defined in claim 3.

9. A hydrogen-enriched cosmetic material container in accordance with claim 2, wherein the hydrogen-encapsulated bag is provided with a check valve.

10. A hydrogen-enriched cosmetic material container in accordance with claim 2, wherein the soft case is accommodated in a hard case formed of a hard material and the pump member is disposed at an opening of the hard case.

11. A liquid cosmetic material encapsulated in the hydrogen-enriched cosmetic material container defined in claim 2.

12. A liquid cosmetic material encapsulated in the hydrogen-enriched cosmetic material container defined in claim 10.

13. A hydrogen-enriched cosmetic material container in accordance with claim 9, wherein the soft case is accommodated in a hard case formed of a hard material and the pump member is disposed at an opening of the hard case.

14. A liquid cosmetic material encapsulated in the hydrogen-enriched cosmetic material container defined in claim 9.

* * * * *